US007406412B2

(12) United States Patent
Vernon et al.

(10) Patent No.: US 7,406,412 B2
(45) Date of Patent: Jul. 29, 2008

(54) REDUCED COMPUTATIONAL COMPLEXITY OF BIT ALLOCATION FOR PERCEPTUAL CODING

(75) Inventors: Stephen Decker Vernon, Hillsborough, CA (US); Charles Quito Robinson, San Francisco, CA (US); Robert Loring Andersen, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 821 days.

(21) Appl. No.: 10/829,453

(22) Filed: Apr. 20, 2004

(65) Prior Publication Data

US 2005/0234716 A1 Oct. 20, 2005

(51) Int. Cl.
*G10L 19/04* (2006.01)

(52) U.S. Cl. ..... 704/229

(58) Field of Classification Search ..... 704/229
See application file for complete search history.

(56) References Cited

U.S. PATENT DOCUMENTS

| | | | | |
|---|---|---|---|---|
| 4,972,484 | A * | 11/1990 | Theile et al. | 704/200.1 |
| 5,721,806 | A | 2/1998 | Lee | |
| 5,825,320 | A * | 10/1998 | Miyamori et al. | 341/139 |
| 5,924,060 | A | 7/1999 | Brandenburg | |
| 6,308,150 | B1 | 10/2001 | Neo et al. | |
| 6,339,757 | B1 | 1/2002 | Teh | |
| 6,687,669 | B1 * | 2/2004 | Schrogmeier et al. | 704/226 |
| 7,318,027 | B2 * | 1/2008 | Lennon et al. | 704/229 |
| 2003/0115050 | A1 | 6/2003 | Chen et al. | |
| 2004/0002859 | A1 | 1/2004 | Liu et al. | |

OTHER PUBLICATIONS

Brandenburg, K. et al., "ISO-MPEG-1 Audio: A Generic Standard for Coding of High-Quality Digital Audio," J. Audio Eng. Soc. vol. 42, No. 10, Oct. 1994.

ATSC Standard: Digital Audio Compression (AC-3), Revision A, Doc. A/52 Dec. 20, 1995; Doc. A/52A Aug. 20, 2001.

Todd, et al., "AC-3: Flexible Perceptual Coding for Audio Transmission and Storage," 96th AES Convention, Feb. 26-Mar. 1, 1994, Amsterdam, preprint 3796 (P3.5).

* cited by examiner

*Primary Examiner*—Susan McFadden
(74) *Attorney, Agent, or Firm*—Gallagher & Lathrop P.C.; David N. Lathrop

(57) ABSTRACT

A process that allocates bits for quantizing spectral components in a perceptual coding system is performed more efficiently by obtaining an accurate estimate of the optimal value for one or more coding parameters that are used in the bit allocation process. In one implementation for a perceptual audio coding system, an accurate estimate of an offset from a calculated psychoacoustic masking curve is derived by selecting an initial value for the offset, calculating the number of bits that would be allocated if the initial offset were used for coding, and estimating the optimum value of the offset from a difference between this calculated number and the number of bits that are actually available for allocation.

6 Claims, 2 Drawing Sheets

REDUCED COMPUTATIONAL COMPLEXITY OF BIT ALLOCATION FOR PERCEPTUAL CODING

TECHNICAL FIELD

The present invention pertains generally to perceptual coding and pertains more specifically to techniques that reduce the computational complexity of processes in perceptual coding systems that allocate bits for encoding source signals.

BACKGROUND ART

Many coding systems are often used to reduce the amount of information required to adequately represent a source signal. By reducing information capacity requirements, a signal representation can be transmitted over channels having lower bandwidth or stored on media using less space.

Perceptual coding can reduce the information capacity requirements of a source audio signal by eliminating either redundant components or irrelevant components in the signal. This type of coding often uses filter banks to reduce redundancy by decorrelating a source signal using a basis set of spectral components, and reduces irrelevancy by adaptive quantization of the spectral components according to psychoperceptual criteria. A coding process that adapts the quantizing resolution more coarsely can reduce information requirements to a greater extent but it also introduces higher levels of quantization error or "quantization noise" into the signal. Perceptual coding systems attempt to control the level of quantization noise so that the noise is "masked" or rendered imperceptible by the spectral content of the signal. These systems typically use perceptual models to predict the levels of quantization noise that can be masked by a source signal.

Spectral components that are deemed to be irrelevant because they are predicted to be imperceptible need not be included in the encoded signal. Other spectral components that are deemed to be relevant can be quantized using a quantizing resolution that is adapted to be fine enough to have the quantization noise rendered just imperceptible by spectral components of the source signal. The quantizing resolution is often controlled by bit allocation processes that determine the number of bits used to represent each quantized spectral component.

Practical coding systems are usually constrained to allocate bits such that the bit rate of an encoded signal conveying the quantized spectral components is either invariant and equal to a target bit rate or variable, perhaps limited to a prescribed range, where the average rate is equal to a target bit rate. For either situation, coding systems often use iterative procedures to determine bit allocations. These iterative procedures search for the values of one or more coding parameters that determine bit allocations such that, according to a perceptual model, quantizing noise is deemed to be masked optimally subject to bit rate constraints. The coding parameters may, for example, specify the bandwidth of the signal to be encoded, the number of channels to be encoded, or the target bit rate.

In many coding systems, each iteration of the bit allocation process requires significant computational resources because bit allocations cannot be easily determined from the coding parameters alone. As a result, it is difficult to implement high-quality perceptual audio encoders for low-cost applications such as consumer video recorders.

One approach to overcome this problem is to use a bit allocation process that terminates the iteration as soon as it finds any values for the coding parameters that result in a bit allocation satisfying the bit-rate constraint. This approach generally sacrifices encoding quality to reduce computational complexity because, in general, such an approach will not find optimal values for the coding parameters. This sacrifice may be acceptable if the target bit rate is sufficiently high but it is not acceptable in many applications that must impose stringent limitations on the bit rate. Furthermore, this approach does not guarantee a reduction in computational complexity because it cannot guarantee that acceptable values of the coding parameters will be found using fewer iterations than would be required to find optimal values.

DISCLOSURE OF INVENTION

It is an object of the present invention to provide for efficient implementations of bit allocation procedures in coding systems so that optimal values of coding parameters be can determined using fewer computational resources.

According to one aspect of the present invention, a source signal is encoded by obtaining a first masking curve that represents perceptual masking effects of the audio signal; deriving, in response to a number of bits that are available for encoding the audio signal, an estimated value of a coding parameter that specifies an offset between a second masking curve and the first masking curve; obtaining an optimum value of the coding parameter by modifying the estimated value of the coding parameter in an iterative process that searches for the optimum value of the coding parameter; generating encoded spectral components by quantizing spectral components according to the second masking curve that is offset from the first masking curve by the optimum value of the coding parameter; and assembling a representation of the encoded spectral components into an output signal.

According to another aspect of the present invention, a source signal is encoded by selecting an initial value for a coding parameter; determining a first number of bits in response to the initial value of the coding parameter; determining a second number of bits from a difference between the first number of bits and a third number of bits that corresponds to a number of bits available to encode the audio signal; deriving an estimated value of the optimum value of the coding parameter in response to the initial value of the coding parameter and the second number of bits; generating encoded spectral components by quantizing information representing the spectral content of the source signal according to the coding parameter; and assembling a representation of the encoded spectral components into an output signal.

The various features of the present invention and its preferred embodiments may be better understood by referring to the following discussion and the accompanying drawings. The contents of the following discussion and the drawings are set forth as examples only and should not be understood to represent limitations upon the scope of the present invention.

MODES FOR CARRYING OUT THE INVENTION

A. Introduction

The present invention provides for efficient implementations of bit allocation procedures that are suitable for use in perceptual coding systems. These bit allocation procedures may be incorporated into transmitters comprising encoders or transcoders that provide encoded bit streams such as those that conform to the encoded bit-stream standard described in the Advanced Television Systems Committee (ATSC) A/52A document entitled "Revision A to Digital Audio Compression (AC-3) Standard" published Aug. 20, 2001, which is incorporated herein by reference in its entirety. Specific implementations for encoders that conform to this ATSC standard are described below; however, various aspects of the present invention may be incorporated into devices for use in a wide variety of coding systems.

Figure 1:
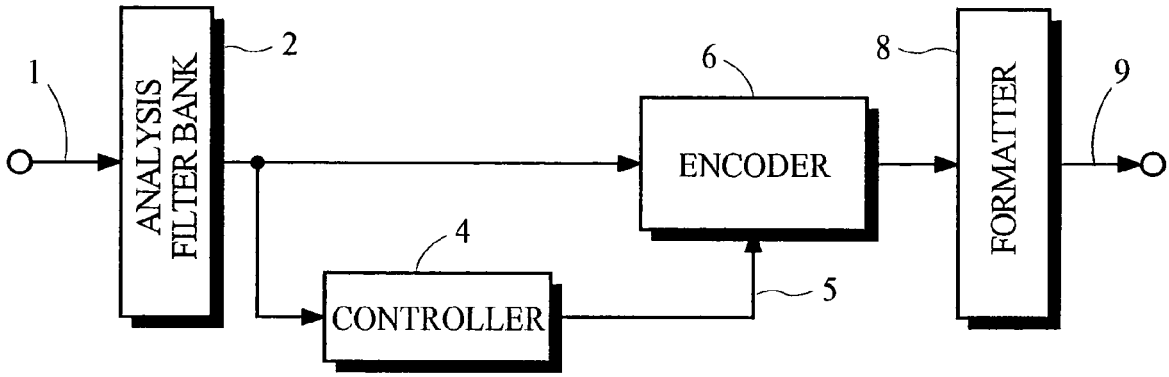
FIG. 1 is a schematic block diagram of one implementation of a transmitter for use in a coding system that may incorporate various aspects of the present invention.

FIG. 1 illustrates a transmitter with a perceptual encoder that may be incorporated into a coding system that conforms to the ATSC standard mentioned above. This transmitter applies the analysis filter bank 2 to a source signal received from the path 1 to generate spectral components that represent the spectral content of the source signal, analyzes the spectral components in the controller 4 to generate encoder control information along the path 5, generates encoded information in the encoder 6 by applying an encoding process to the spectral components that is adapted in response to the encoder control information, and applies the formatter 8 to the encoded information to generate an output signal suitable for transmission along the path 9. The output signal may be delivered immediately to a companion receiver or recorded on storage media for subsequent delivery.

The analysis filter bank 2 may be implemented in variety of ways including infinite impulse response (IIR) filters, finite impulse response (FIR) filters, lattice filters and wavelet transforms. In a preferred implementation that conforms to the ATSC standard, the analysis filter bank 2 is implemented by the Modified Discrete Cosine Transform (MDCT) that is described in Princen et al., "Subband/Transform Coding Using Filter Bank Designs Based on Time Domain Aliasing Cancellation," Proc. of the 1987 International Conference on Acoustics, Speech and Signal Processing (ICASSP), May 1987, pp. 2161-64.

The encoder 6 may implement essentially any encoding process that may be desired for a particular application. In this disclosure, terms like "encoder" and "encoding" are not intended to imply any particular type of information processing other than adaptive bit allocation and quantization. This type of processing is often used in coding systems to reduce information capacity requirements of a source signal. Additional types of processing may be performed in the encoder 6 such as discarding spectral components for a portion of a signal bandwidth and providing an estimate of the spectral envelope of the discarded portion in the encoded information.

The controller 4 may implement a wide variety of processes to generate the encoder control information. In a preferred implementation, the controller 4 applies a perceptual model to the spectral components to obtain a "masking curve" that represents an estimate of the masking effects of the source signal and derives one or more coding parameters that are used with the masking curve to determine how bits should be allocated to quantize the spectral components. Some examples are described below.

The formatter 8 may use multiplexing or other known processes to generate the output signal in a form that is suitable for a particular application.

B. Encoder Control

A typical controller 4 in perceptual coding systems applies a perceptual model to the spectral components received from the analysis filterbank 2 to obtain a masking curve. This masking curve estimates the masking effects of the spectral components in the source signal. A transmitter and receiver in a perceptual coding system can deliver a subjective or perceived high-quality output signal by controlling the allocation of bits and the quantization of spectral components in the transmitter so that the quantization noise level is kept just below the masking curve. Unfortunately, this type of encoding process cannot be used in coding systems that conform to a variety of coding standards including the ATSC standard mentioned above because many standards require that an encoded signal have a bit rate that either is invariant or is constrained to vary within a very limited range of rates. The encoders that conform to such standards generally use iteration to search for coding parameters that can be used to generate an encoded signal having a bit rate that is within acceptable limits.

1. Preferred Technique

In one implementation for use with encoding that conforms to the ATSC standard, the controller 4 performs an iterative process that (1) applies a perceptual model to the spectral components received from the analysis filterbank 2 to obtain an initial masking curve, (2) selects an offset coding parameter that represents a difference in level between the initial masking curve and an identically shaped tentative masking curve, (3) calculates the number of bits that are required to quantize the spectral components such that the level of quantization noise is kept just below the tentative masking curve, (4) compares the calculated number of bits with the number of bits that are available to allocate for quantization, (5) adjusts the value of the offset coding parameter to either raise or lower the tentative masking curve when the calculated number of bits is either too large or too small, respectively, and (6) iterates the calculation of the number of bits, the comparison of the calculated number of bits with the number of available bits, and the adjustment of the coding parameter to find a value for the offset coding parameter that brings the calculated number of bits within an acceptable range. The iteration uses a numerical method known as "bisection" or "binary search" that identifies the optimum value of the offset coding parameter. Additional details regarding this numerical method may be obtained from Press et al., "Numerical Recipes," Cambridge University Press, 1986, pp. 89-92.

Figure 2:
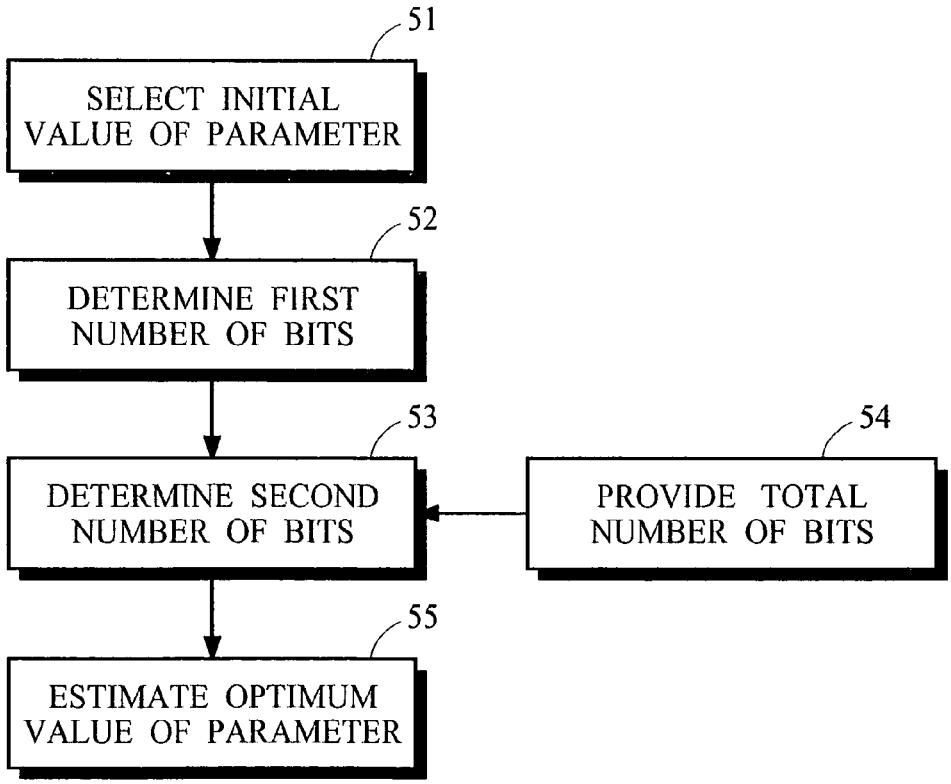
FIG. 2 is process flow diagram of one method for deriving an estimated value of a coding parameter.

The present invention reduces the computational resources required by the controller 4 to perform iterative processes such as the one described above by efficiently deriving accurate estimates of one or more coding parameters. For the particular process described above, the present invention may be used to provide an accurate estimate of the offset coding parameter. This may be done using the process shown in FIG. 2. According to this process, step 51 selects an initial value $p_I$ of the coding parameter to obtain a tentative masking curve. Step 52 calculates the number of bits $b_1$ that are required to quantize spectral components such that the quantization noise level is kept just below the tentative masking curve. This calculation may be expressed conceptually as $b_1=F(p_I)$, where the function F( ) represents the process used to calculate the number of bits in response to the coding parameter. Step 53 determines a second number of bits $b_2$ by calculating a difference between the first number of bits b, and a third number of bits $b_3$ that corresponds to the number of bits that are available to allocate for quantizing the spectral components. This difference may be expressed conceptually as $b_2=(b_1-b_3)$, however, it should be understood that any or all of the values in this conceptual expression may be scaled by a suitable factor, if desired. Step 55 derives an accurate estimate $p_E$ for the optimum value of the offset coding parameter from the second number of bits $b_2$. This may be expressed conceptually as $p_E=E(b_2)$, where the function E( ) represents the process used to estimate the optimum value in response to the second number of bits.

The inventors have discovered that expressions for a function E( ) can be derived empirically. One expression for the function is described below, which was derived for a particular implementation of an encoder that generates encoded information conforming to the ATSC standard. In this implementation, five channels of source signals are each sampled at 48 kHz. Each channel has a bandwidth of about 20.3 kHz. The bit rate for the complete encoded bit stream is fixed and equals 448 kbits/sec. Spectral components for each of the channels are generated by the MDCT filterbank described above, which is applied to segments of 512 source signal samples that overlap one another by 256 samples to obtain blocks of 256 MDCT coefficients. Six blocks of coefficients for each channel are assembled into a frame. The spectral components in each block are represented in a form that comprises a scaled value associated with an exponential-valued scale factor or exponent. One or more scaled values may be associated with a common exponent as explained in the ATSC A/52A document mentioned above. The number of bits $b_3$ represents the number of bits that are available to quantize the scaled values in a frame. A coding technique known as coupling, in which spectral components for multiple channels are combined to form a composite spectral presentation, is inhibited for this particular implementation. The particular coding parameter that is estimated by the function E( ) specifies an offset between an initial masking curve and a tentative masking curve as described briefly above. Additional details may be obtained from the ATSC A/52A document.

Figure 3:
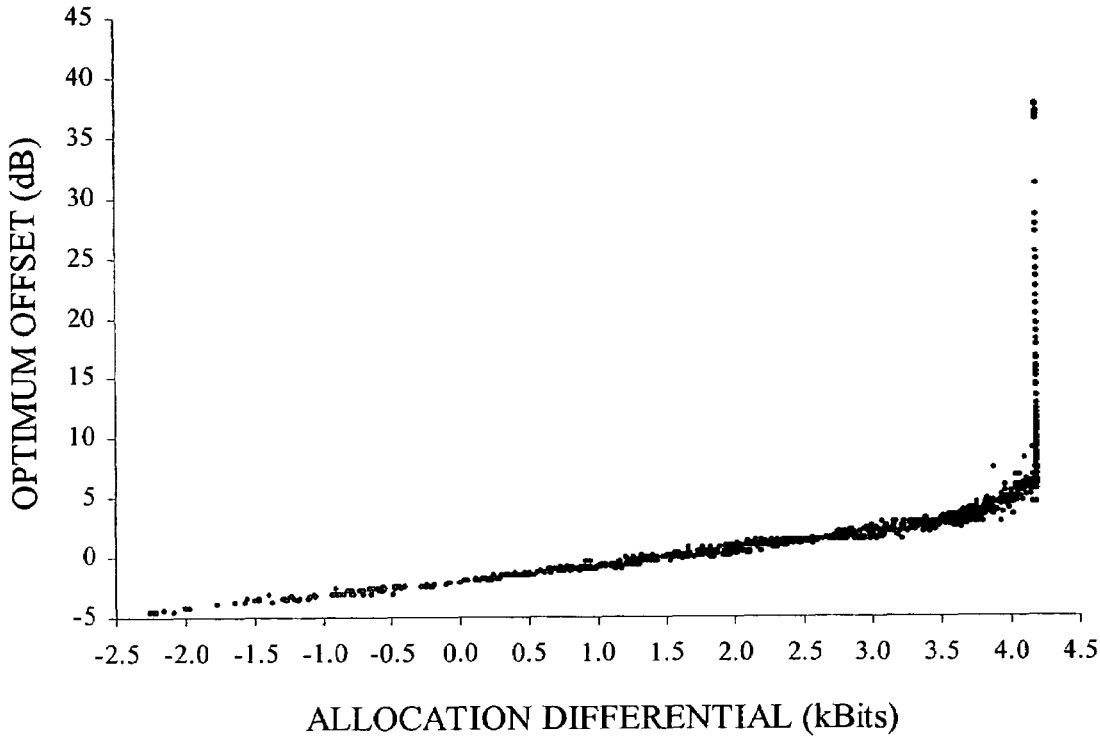
FIG. 3 is a graphical illustration of a relationship between a calculated number of bits and an optimum value of a coding parameter.

The graph in FIG. 3 shows an empirically-derived relationship between the difference value $b_2$ and an optimal value $p_O$ for the offset coding parameter for frames of spectral components representing the spectral content of a variety of source signals. The value for the offset is expressed in dB relative to the level of the initial masking curve, where 6.02 dB (20 log 2) corresponds approximately to a change in the quantization noise level caused by a one bit change in the allocation of a spectral component. The graph was obtained by determining an initial masking threshold for each block in a frame, selecting an initial offset value $p_I$ equal to −1.875 dB for each block, calculating the number of bits $b_1$ required to quantize the spectral component scaled values in the frame for this offset, and calculating the number of "remaining bits" $b_2$ from a difference between the calculated number of bits $b_1$ and the number of bits $b_3$ available to represent the quantized spectral component scaled values. The optimal value $p_O$ for the offset coding parameter was determined for all blocks in the frame using the iterative binary search process described above. Each point in the graph shown in FIG. 3 represents the calculated difference $b_2$ and the subsequently determined optimal value $p_O$ for the offset coding parameter for a respective frame. The optimal value $p_O$ for the offset coding parameter is represented along the y-axis with respect to the number of remaining bits $b_2$ on the x-axis. Although empirical results indicate the choice of the initial value $p_I$ of the offset coding parameter does have an effect on the accuracy of the estimated optimal value $p_E$, these results also indicate the effect is small and the error in the estimated value is relatively insensitive to the choice of the initial value $p_1$. By using the estimated value $p_E$ as the beginning offset for the binary search process described above, empirical tests have shown the iterative search is able to converge to the optimum value $p_o$ of the coding parameter for about 99% of the frames after only five iterations, which is half the number of iterations used with the conventional method for selecting the beginning value for this parameter.

The points shown in the graph of FIG. 3 are tightly clustered along a line, which indicates an accurate estimate $p_E$ for the optimum value $p_O$ of the offset coding parameter may be obtained from a linear function $E(b_2)$ derived from fitting a line to the points. The shape of the cluster shown in the graph indicates that the variance in the estimated value $p_E$ increases for large positive values of the difference value $b_2$. This increase in variance means the accuracy of the estimation is less certain but this uncertainty is not important in a practical implementation because large positive values of $b_2$ indicate a significant surplus of bits are available to quantize the spectral components. In such instances, it is not as important to find the optimal value of the coding parameter because a reasonable estimate of the optimum value is likely to result in all quantization noise being masked.

The function $E(b_2)$ can be derived from a line or curve fit to the points, preferably emphasizing a minimization of the error of fit for negative values and small positive values of $b_2$. The particular relationship shown in the graph of FIG. 3 can be approximated with reasonable accuracy by the linear equation $p_E=E(b_2)=1.196\cdot b_2-1.915$.

2. Alternate Technique

The preferred technique described above uses the estimated optimum value $p_E$ of the offset coding parameter as the beginning value in a binary search for the true optimum value $p_O$ of this parameter. The optimum offset value $p_O$ found by the search and the initial masking curve collectively specify a final masking curve that is used to calculate the bit allocations for quantization of all spectral components in a frame.

In an alternate technique, the estimated optimal value $p_E$ is used with the initial masking curve to calculate the bit allocation for spectral components in at least some but not all blocks in a frame and the optimal value $p_O$ is used with the initial masking curve to calculate the bit allocation for the remaining blocks in the frame.

In one example of this alternative technique, the estimated value $p_E$ is used to calculate the bit allocation for spectral components in five blocks of each channel in a frame. Following this allocation, the remaining bits are allocated among the spectral components in the remaining one block for each channel using an optimal value $p_O$ that is determined by iteration. Preferably, the iteration uses a beginning value that is estimated as described above. An example of this technique may be implemented by performing the following steps:

(1) select initial value $p_1$ of the offset coding parameter
(2) calculate initial bit allocation $b_1=F(p_I)$
(3) calculate number of remaining bits $b_2=b_3-b_1$
(4) estimate optimum value of coding parameter $p_E=E(b_2)$
(5) calculate bit allocation $b_4=F(p_E)$
(6) quantize five blocks per channel using offset $p_E$ and allocation $b_4$
(7) calculate number of remaining bits $b_5=b_3-b_4$
(8) iteratively determine optimum value $p_O$ for remaining blocks using $p_E$ as starting value
(9) quantize remaining block per channel using offset $p_o$ and allocation $b_5$ In another example, the estimated value $p_E$ is used to calculate the bit allocation for the spectral components in all blocks of some of the channels in a frame and the optimum value $p_O$, determined by iteration, is used to calculate the bit allocation for spectral components in at least one block for the other channels in the frame. The estimated and optimal values of the offset coding parameter may be used in a variety of ways to calculate the bit allocations for respective blocks of spectral components. Preferably, the iterative binary search process that determines the optimum value $p_O$ uses the estimated value $p_E$ as its beginning value as described above.

C. Implementation

Figure 4:
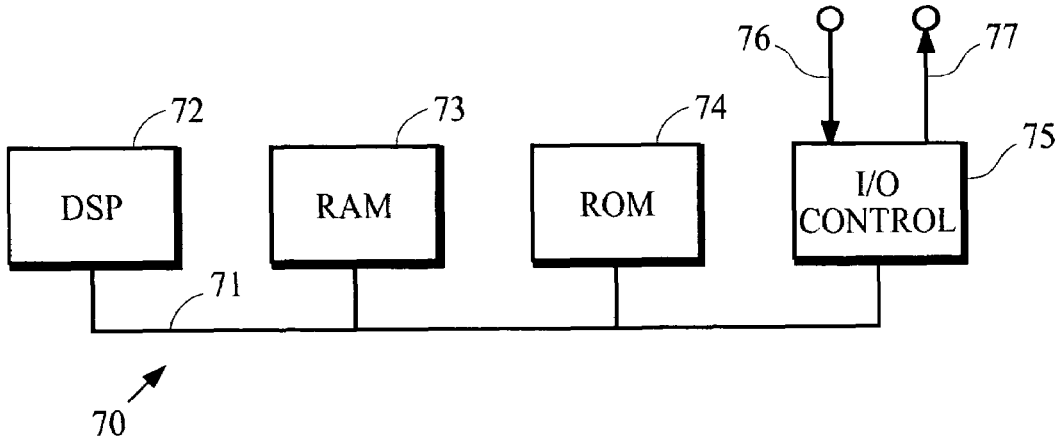
FIG. 4 is a schematic block diagram of a device that may be used to implement various aspects of the present invention.

Devices that incorporate various aspects of the present invention may be implemented in a variety of ways including software for execution by a computer or some other apparatus that includes more specialized components such as digital signal processor (DSP) circuitry coupled to components similar to those found in a general-purpose computer. FIG. 4 is a schematic block diagram of device 70 that may be used to implement aspects of the present invention. DSP 72 provides computing resources. RAM 73 is system random access memory (RAM) used by DSP 72 for signal processing. ROM 74 represents some form of persistent storage such as read only memory (ROM) for storing programs needed to operate device 70 and to carry out various aspects of the present invention. I/O control 75 represents interface circuitry to receive and transmit signals by way of communication channels 76, 77. Analog-to-digital converters and digital-to-analog converters may be included in I/O control 75 as desired to receive and/or transmit analog signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media like paper.

The invention claimed is:

1. A method for encoding an audio signal that comprises:

receiving spectral components that represent spectral content of the audio signal;

applying a perceptual model to the spectral components to obtain a first masking curve that represents perceptual masking effects of the audio signal;

deriving an estimated value of a coding parameter that specifies an offset between a second masking curve and the first masking curve, wherein the estimated value of the coding parameter is derived in response to a number of bits that are available for encoding the audio signal, and wherein the deriving of the estimated value of the coding parameter comprises:

selecting an initial value for the coding parameter;

determining a first number of bits in response to the initial value of the coding parameter to use in quantizing the spectral components;

determining a second number of bits from a difference between the first number of bits and a third number of bits, wherein the third number of bits corresponds to the number of bits that are available for encoding the audio signal; and deriving the estimated value of the coding parameter in response to the initial value of the coding parameter and the second number of bits;

obtaining an optimum value of the coding parameter by modifying the estimated value of the coding parameter in an iterative process that searches for the optimum value of the coding parameter according to the perceptual model;

generating encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perceptual model; and assembling a representation of the encoded spectral components into an output signal.

2. A method for encoding an audio signal that comprises:

receiving spectral components that represent spectral content of the audio signal, wherein the spectral components are arranged in a plurality of blocks, the plurality of blocks being arranged in a frame blocks;

applying a perceptual model to the spectral components to obtain a first masking curve that represents perceptual masking effects of the audio signal;

deriving an estimated value of a coding parameter that specifies an offset between a second masking curve and the first masking curve, wherein the estimated value of the coding parameter is derived in response to a number of bits that are available for encoding the audio signal;

obtaining an optimum value of the coding parameter by modifying the estimated value of the coding parameter in an iterative process that searches for the optimum value of the coding parameter according to the perceptual model;

generating encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perceptual model, and wherein encoded spectral components are generated by quantizing at least some but not all blocks of spectral components in the frame according to the estimated value of the coding parameter; and assembling a representation of the encoded spectral components into an output signal.

3. A medium conveying a program of instructions that is executable by a device to perform a method for encoding an audio signal that comprises:

receiving spectral components that represent spectral content of the audio signal:

applying a perceptual model to the spectral components to obtain a first masking curve that represents perceptual masking effects of the audio signal;

deriving an estimated value of a coding parameter that specifies an offset between a second masking curve and the first masking curve, wherein the estimated value of the coding parameter is derived in response to a number of bits that are available for encoding the audio signal, and wherein derivation of the estimated value of the coding parameter comprises:

selecting an initial value for the coding parameter, determining a first number of bits in response to the initial value of the coding parameter to use in quantizing the spectral components;

determining a second number of bits from a difference between the first number of bits and a third number of bits, wherein the third number of bits corresponds to the number of bits that are available for encoding the audio signal; and deriving the estimated value of the coding parameter in response to the initial value of the coding parameter and the second number of bits;

obtaining an optimum value of the coding parameter by modifying the estimated value of the coding parameter in an iterative process that searches for the optimum value of the coding parameter according to the perceptual model;

generating encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perpetual model; and assembling a representation of the encoded spectral components into an output signal.

4. A medium conveying a program of instructions that is executable by a device to perform a method for encoding an audio signal that comprises:

receiving spectral components that represent spectral content of the audio signal, wherein the spectral components are arranged in a plurality of blocks, the plurality of blocks being arranged in a frame of blocks;

applying a perceptual model to the spectral components to obtain a first masking curve that represents perceptual masking effects of the audio signal;

deriving an estimated value of a coding parameter that specifies an offset between a second masking curve and the first masking curve, wherein the estimated value of the coding parameter is derived in response to a number of bits that are available for encoding the audio signal;

obtaining an optimum value of the coding parameter by modifying the estimated value of the coding parameter in an iterative process that searches for the optimum value of the coding parameter according to the perceptual model;

generating encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perceptual model, and wherein encoded spectral components are generated by quantizing at least same but not all blocks of spectral components in the frame according to the estimated value of the coding parameter; and assembling a representation of the encoded spectral components into an output signal.

5. An apparatus for encoding an audio signal that comprises:

(a) an input terminal;

(b) an output terminal; and (c) signal processing circuitry coupled to the input terminal and the output terminal, wherein the signal processing circuitry is adapted to:

receive a signal from the input terminal and obtain thereform spectral components that represent spectral content of the audio signal;

apply a perceptual model to the spectral components to obtain a first masking curve that represents perceptual masking effects of the audio signal;

derive an estimated value of a coding parameter that specifies an offset between a second masking curve and the first masking curve, wherein the estimated value of the coding parameter is derived in response to a number of bits that are available for encoding the audio signal, wherein derivation of the estimated value of the coding parameter comprises:

selecting an initial value for the coding parameter;

determining a first number of bits in response to the initial value of the coding parameter to use in quantizing the spectral components;

determining a second number of bits from a difference between the first number of bits and a third number of bits, wherein the third number of bits corresponds to the number of bits that are available for encoding the audio signal; and deriving the estimated value of the coding parameter in response to the initial value of the coding parameter and the second number of bits;

obtain an optimum value of the coding parameter by modifying the estimated value of the coding parameter in an iterative process that searches for the optimum value of the coding parameter according to the perceptual model;

generate encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perceptual model; and assemble a representation of the encoded spectral components into an output signal that is sent to the output terminal.

6. An apparatus for encoding an audio signal that comprises:

(a) an input terminal (b) an output terminal; and (c) signal processing circuitry coupled to the input terminal and the output terminal, wherein the signal processing circuitry is adapted to:

receive a signal from the input terminal and obtain thereform spectral components that represent spectral content of the audio signal, wherein the spectral components are arranged in a plurality of blocks, the plurality of blocks being arranged in a frame of blocks;

apply a perceptual model to the spectral components to obtain a first masking curve that represents perceptual masking effects of the audio signal;

derive an estimated value of a coding parameter that specifies an offset between a second masking curve and the first masking curve, wherein the estimated value of the coding parameter is derived in response to a number of bits that are available for encoding the audio signal;

obtain an optimum value of the coding parameter by modifying the estimated value of the coding parameter in an iterative process that searches for the optimum value of the coding parameter according to the perceptual model;

generate encoded spectral components by quantizing spectral components according to the second masking curve, wherein resolution of the quantizing is responsive to the first masking curve and the coding parameter such that the optimum value of the coding parameter minimizes perceptibilty of quantizing noise according to the perceptual model, and wherein encoded spectral components are generated by quantizing at least some but not all blocks of spectral components in the frame according to the estimated value of the coding parameter; and assemble a representation of the encoded spectral components into an output signal that is sent to the output terminal.

* * * * *